US005573708A

United States Patent [19]

Otomo

[11] Patent Number: 5,573,708

[45] Date of Patent: Nov. 12, 1996

[54] RUST INHIBITOR

[75] Inventor: Shigeru Otomo, Abiko, Japan

[73] Assignee: Union Chemical Co., Ltd., Saitama-ken, Japan

[21] Appl. No.: 504,950

[22] Filed: Jul. 20, 1995

Related U.S. Application Data

[62] Division of Ser. No. 317,778, Oct. 4, 1994, Pat. No. 5,487,846, which is a continuation of Ser. No. 46,305, Apr. 15, 1993, abandoned.

[30] Foreign Application Priority Data

May 15, 1992 [JP] Japan ..... 4-148837

[51] Int. Cl.[6] ..... C23F 11/12; C23F 11/14; C23F 11/16

[52] U.S. Cl. ..... 252/389.61; 252/388; 252/389.62; 252/392; 422/7; 422/16

[58] Field of Search ..... 252/388, 389.62, 252/392, 389.61; 422/7, 15, 16, 18

[56] References Cited

U.S. PATENT DOCUMENTS

| | | | |
|---|---|---|---|
| 2,583,399 | 1/1952 | Wachter et al. | 507/259 |
| 2,678,947 | 5/1954 | Jones | 562/83 |
| 3,751,491 | 8/1973 | Houlihan | 570/127 |
| 3,843,337 | 10/1974 | Korpics | 44/343 |
| 4,051,168 | 9/1977 | Feiring | 558/56 |
| 4,278,561 | 7/1981 | Yee | 252/408 |
| 4,278,791 | 7/1981 | Botta et al. | 548/113 |

FOREIGN PATENT DOCUMENTS

| | | |
|---|---|---|
| 3330223 | 3/1985 | Germany . |
| 59-133377 | 7/1984 | Japan . |
| 4-244054 | 1/1992 | Japan . |

OTHER PUBLICATIONS

Chemical Abstract 79:115594 only JP 48026012 Aug. 3, 1969.

Chemical Abstract 120:83840 only JP EP 569884 Nov. 18, 1993.

*Primary Examiner*—Sharon Gibson
*Assistant Examiner*—Valerie O. Fee
*Attorney, Agent, or Firm*—Finnegan, Henderson, Farabow, Garrett & Dunner, L.L.P.

[57] ABSTRACT

A general-purpose organic rust inhibitor which can effectively prevent corrosion of metals, and which comprising a compound represented by the general formula (1):

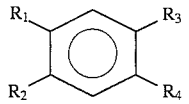

(1)

wherein, in the above general formula (1), $R_1$ represents a fluorine-substituted alkyl group; $R_2$ is a hydrogen atom or a group defined for $R_1$ or an organic residue; $R_3$ and $R_4$ are hydrogen or an ionizable group at least for either of the two, or an ionizable group in which $R_3$ and $R_4$ are connected to each other.

11 Claims, No Drawings

RUST INHIBITOR

This is a division of application Ser. No. 08/317,778, filed Oct. 4, 1994, now U.S. Pat. No. 5,487,846, which is a continuation of Ser. No. 08/046,305, filed Apr. 15, 1993, now abandoned.

BACKGROUND OF THE INVENTION

The present invention relates to a rust inhibitor, specifically to a rust inhibitor comprising a specific fluorine-substituted alkyl benzene derivative which is brought into contact with a metal surface, thereby inhibiting rust formation on the metal.

There have, heretofore, been many methods for inhibiting rust formation on the surface of metal materials, for which purposes numerous rust inhibitors have been proposed and used in practice. For example, inorganic materials, such as sodium polyphosphate and nitrile salts are well known. Problems of environmental destruction including marine pollution have lately focused attention on organic materials. Typical organic rust inhibitors heretofore known include vegetable oils, certain fatty acids, sulfonated hydrocarbon oils, benzotriazoles, dicyclohexylamine salts, and the like, which are effective for specific metals. However, these organic materials are unsatisfactory as excellent general-purpose rust inhibitors.

SUMMARY OF THE INVENTION

Thus, an object of the present invention is to provide excellent general-purpose organic rust inhibitors which can effectively prevent corrosion of metals, such as steel, copper, chromium, manganese, nickel, and aluminum, as well as alloys based on these components, or noble metals, such as gold, silver, and alloys containing these metals.

The present inventor has made intensive investigation on anticorrosion mechanisms of the known organic rust inhibitors, and has discovered that the strong bonding of the inhibitors to the metal surface is important to protect the surface so as to retain excellent rust inhibition. The above object of the present invention is met by aromatic compounds having specific fluorine-containing alkyl groups represented by the general formula (1):

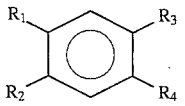

(1)

(wherein, in the above general formula, $R_1$ represents a fluorine-substituted alkyl group; $R_2$ is a hydrogen atom or a group defined for $R_1$ or an organic residue; $R_3$ and $R_4$ are hydrogen or an ionizable group at least for either of the two or an ionizable group in which $R_1$ and $R_4$ are connected to each other).

DETAILED DESCRIPTION OF THE PREFERRED EMBODIMENTS

The fluorine-substituted alkyl-group represented by $R_1$ in general formula (1) used in the present invention includes, for example, alkyl groups containing not more than 20 carbon atoms substituted by at least one fluorine atom, with the alkyl group being optionally substitued by residues other than hydrogen atoms, such as chlorine, hydroxyl, and acetyl, such as monofluoromethyl, difluoromethyl, trifluoromethyl, monofluorodichloromethyl, difluorochloro-methyl, pentafluoroethyl, isoheptafluoropropyl, normalheptafluoropropyl, isononafluorobutyl, tertiary nonafluorobutyl, normal-nonafluorobutyl, and the like.

$R_2$ represents a hydrogen atoms, a group defined by $R_1$ or a group selected from organic residues where the organic residue includes organic residues containing not more than 6 carbon atoms, such as methyl, ethyl, propyl, isopropyl, butyl, isobutyl, tertiary butyl, methoxy, ethoxy, acetoxy, aryl groups, and the like.

$R_3$ and $R_4$ are selected independently from hydrogen atoms and ionizable groups, where at least either $R_3$ or $R_4$ is an ioniable group, the ionizable groups being for example, sulfino, sulfonic, carbomethoxy, carboxymethylthio, carboxymethyl sulfonyl, N-(carboxymethyl)-aminosulfonyl, N-(carboxymethyl)carbamoyl, 2-carboxyethylthio, 2-carboxyethyl sulfonyl, N-(2-carboxyethyl)aminosulfonyl, N-(2-carboxyethyl)carbamoyl, 3-carboxypropylthio, 3-carboxypropyl sulfonyl, 3-carboxypropyl aminosulfonyl, N-(3-carboxypropyl)carbamoyl, carbamoyl, aminosulfonyl, N-hydroxycarbamoyl, N-hydroxyaminosulfonyl, phosphono, phosphonoxy, phosphino, hydroxy, carboxy, and mercapto. In addition, $R_3$ and $R_4$ are groups which may be bonded together to generate triazole, thiazole, imiadazole, pyrazole, iminodicarbonyl, iminodisulfonyl, iminocarbonyl sulfonyl, and the like, so as to be able to dissociate hydrogen ions; or the dissociable hydrogen ions of these groups may be substituted by metal atom ions or partially substituted by metal atom ion, such as alkali metals, such as lithium, sodium, potassium, and rubidium, alkaline earth metals, such as beryllium, magnesium, calcium, strontium, and barium, titanium, yttrium, zirconium, iron, aluminum, nickel, zinc, tin, lead, and cadmium, or groups which formed organic amine salts with amines, trimethyl amine, monoethanol amine, dectanol amine, triethanol amine, morpholine, dicyclohexylamine, pyridine, tripropanol amine, polyethylene imine, vinyl pyridine, polyvinyl pyridine, and the like.

Preferred examples of the compound represented by the above general formula (1) of the present invention are as follows:

| | |
|---|---|
| No. 1 | Sodium 3,4-bis(trifluoromethyl)benzenesulfonate |
| No. 2 | Calcium 3-heptafluoroethyl-6-hydroxybenzoate |
| No. 3 | Triethanol amine salt of p-tertiarynonafluorobutylbenzenesulfonate |
| No. 4 | Sodium p-trifluoromethylbenzenesulfonyl aminoacetate |
| No. 5 | Sodium p-heptafluoroethylphenyl thioacetate |
| No. 6 | Pottasium m-trifluoromethylbenzotriazole salt |
| No. 7 | M-trifluoromethyl benzotriazole |
| No. 8 | Dicyclohexylamine p-trifluoromethylphenylsulfonate salt |
| No. 9 | Potassium m-tertiarynonafluorobutyl saccharine salt |
| No. 10 | Sodium p-trifluoromethylbenzoate |

These compounds represented by the above general formula (1) of the present invention can be synthesized by known methods; in particular, the fluoroalkyl groups are readily obtained by fluorine substitutions of chloro or bromo alkyl groups.

In general, an alkyl group of an alkyl benzene is chlorinated or brominated followed by replacing it with fluorine or the like, to give a fluoroalkyl aromatic group, and then introducing an ionizable group, or else the alkyl group of the goal compound is fluorinated to prepare these compounds.

Specifically, compound No. 1 is prepared by side chain chlorination of 3,4-dimethylbenzene sulfonic acid, thereby resulting is 3,4-bis(trichloromethyl) benzenesulfonic acid. Then, in alkaline water, the compound is subjected to substitution with potassium fluoride to obtain the goal compound No. 1.

However, the present invention is in no way restricted by the method of manufacture of these compounds.

The rust inhibitor of the present invention, which is either a compound represented by the above general formula (1) alone or a plurality of compounds thereof in combination, is brought into contact with the metal material to be protected against corrosion, thereby showing its effectiveness, wherein optionally it is used by incorporating, dispersing or dissolving in water, organic solvents, detergents, lubricating oils, cotton oil, rubber, a resin coating, such as an alkyd resin, or a synthetic resin to give a composition, which is then brought into contact with the metal material, or else the composition is then brought into contact with the metal followed by vaporizing off the water, solvent, or the like, thereby exhibiting its effectiveness.

Either application can be used in conjunction with a known rust inhibitor where its rust inhibitory effect can be further enhanced by incorporating one or a plurality of a surface active agent, a dispersant, a dye, a pigment, a flavor, an antiweathering agent, an antioxidant, sodium silicate, a filler, or the like additive.

The rust inhibitor of the present invention is in no way restricted by specifying a combination with these materials or its use or the application to specific metals.

Metals which the present invention targets for corrosion inhibition are metals such as iron, copper, choromium, manganese, nickel, aluminum, titanium, tantalum, molybdenum, and tin, as well as alloys based on these components, or reinforced alloys obtained by adding small amounts of other metals, carbon, boron, silicon, or the like, or noble metals, such as gold and silver and alloys containing these metals.

These metals or alloys are used in a variety of applications including sundries, architectual materials, vehicle steel, tools, machines, and their parts, aircraft materials, marine materials, electronic materials and their parts, electronic device materials, communication materials, and the like.

EXAMPLES

The present invention is further described in detail by the following examples. However, in no way will the present invention be limited by the following examples.

EXAMPLE 1 AND CONTROL EXAMPLE 1

0.5 g of compound No. 1 was dissolved in 100 ml of 5% by weight brine and placed in a dish (Example 1). A similar solution was prepared except for using p-tertiary butyl benzoic acid as a control example (Control Example 1). In these dishes were placed sandpaper, a toluene-degreased steel coupon (SS41, 50×50×2 mm), followed by placing a lid on top and allowing it to stand for 24 hours at 40° C.

These two coupons after standing were removed and subjected to observation which indicated no change on the surface of the steel coupon of Example 1 with the solution remaining colorless and transparent; on the other hand, the surface of the steel coupon of Control Example 1 was yellow with the solution remaining having changed to a light brown color.

EXAMPLE 2

Test steel coupons (SPCC B) were subjected to a brine spray test (JIS Z 2371) and wetting test (JIS K 2246. )

The following composition was prepared and coated onto test pieces, followed by drying for six hours at room temperature and submitting to tests, to give the results shown in Table 1.

| | |
|---|---|
| Microwax | 30% by weight |
| Lanolin | 10 |
| Mixed Xylene | 59 |
| Triisopropanol Amine | 0.5 |
| Rust Inhibitor | 0.5 |

TABLE 1

| | Rust Inhibotor | Brine Spray Test (24 hrs.) | Wetting Test (400 hrs.) |
|---|---|---|---|
| Example Nos. | | | |
| 2-1 | Compound No. 2 | No rusting | No rusting |
| 2-2 | Compound No. 3 | No rusting | No rusting |
| 2-3 | Compound No. 4 | No rusting | No rusting |
| 2-4 | Compound No. 5 | No rusting | No rusting |
| Control Example Nos. | | | |
| 2-1 | Ca-Petroleum Sulfonate | Extensive rusting | Rusting |
| 2-2 | Sodium Lauroyl Amino Acetate | Rusting | Slight rusting |
| 2-3 | Socium Stearoyl Thio Acetate | Rusting | No rusting |

EXAMPLE 3

An antifreeze (ethylene-glycol-based, JIS Specification PT Grade) containing 1% by weight of a rust inhibitor of the present invention was prepared and subjected to a rust inhibition evaluation as an antifreeze according to JIS K 2234.

Each of these antifreeze samples containing each rust inhibitor was diluted to 30% by volume with synthetic water solutions prepared by the aforementioned test method, to permit immersing in the solution, according to the specified method, a test piece which had been subjected to the specified treatment (a 50×25 mm piece with a 6.6 mm diameter hole drilled through the center; the aluminum and the solder were about 3 mm thick, and the copper and brass were 1.6 mm thick), followed by introducing dry air from an air inlet tube at a rate of 100ml/min while they were held at 88±2° C. for 336 hours.

On completing the test, the test pieces were, according to the specified procedure weighed accurately to 0.1 mg to compute the weight reduction, expressed in units of mg/cm$^2$, with the results given in Table 2.

TABLE 2

| | Rust Inhibitor | Aluminum | Brast | Solder | Copper |
|---|---|---|---|---|---|
| Example Nos. | | | | | |
| 3-1 | Compound No. 6 | 0.10 | 0.04 | 0.09 | 0.02 |
| 3-2 | Compound No. 7 | 0.05 | 0.06 | 0.06 | 0.04 |
| Control Example Nos. | | | | | |
| 3-1 | Benzotriazole | 0.52 | 0.14 | 0.42 | 0.09 |
| 3-2 | Benzotriazole | 0.46 | 0.20 | 0.53 | 0.15 |

Table 2 clearly shows that the rust inhibitors of the present invention gave considerably low numerical values indicating an appreciable inhibition of corrosion of these metal materials.

EXAMPLE 4 AND CONTROL EXAMPLE 4

Super-mild steel test pieces (50×50×2 mm) were evenly sprayed with an ethanol solution of 1% by weight of compound No. 8 (Exampel 4) or with dicyclohexyl ammonium nitrite (Control Example 4) as the control example and were left standing for 50 horus at 40° C. and at a humidity of 90%. Example 4 revealed no change at all, but Control Example 4 showed brown-colored rust formation.

EXAMPLE 5 AND CONTROL EXAMPLE 5

0.5 g of compound No. 9 (Example 5-1) or compound No. 10 (Example 5-2) was dissolved in 100ml of city water and placed in a dish; a similar solution was prepared (Control Example 5) except for using sodium p-tertiary butyl benzoate. In these dishes were immersed sandpapered, toluene-degreased steel coupons (SS41, 50×50×2 mm), followed by standing at 25° C. for 240 hours.

After standing, each coupon was taken out for observation which indicated no changes on the surface of steel coupons in Examples 5-1 and 5-2, giving colorless and transparent remaining solutions, but the surface of the steel coupon of Control Example 5 was discolored and brown giving a red-brown colored turbid remaining solution.

The rust inhibitor of the present invention, clearly demonstrated in these examples, exhibits superior rust inhibitory effects compared to the known rust inhibitors and, thus, can be used singly or in combinations with other materials in a multi-purpose rust inhibitory application.

What is claimed is:

1. A method of inhibiting rust comprising applying to a substrate a rust inhibiting compound of the formula (1):

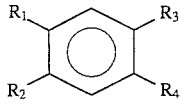

(1)

wherein, $R_1$ is a perfluoroalkyl group having one to six carbon atoms; $R_2$ is a hydrogen atom or a group defined for $R_1$; $R_4$ is an acid group selected from —OH—COOH, —SH, —$SO_2OH$, —$PO(OH)_2$, —$SCH_2COOH$, —$SO_2NHCH_2COOH$ or a salt thereof; $R_3$ is a hydrogen atom or a group defined for $R_4$; or $R_3$ and $R_4$ together form an acid group selected from —N——N—NH—, —CH——N—N—, —$CO_2$—NH—CO—, —S—C(SH)——N' or a salt thereof.

2. A method of inhibiting rust comprising applying to a substrate sodium 3,4-bis(trifluoromethyl)benzenesulfonate.

3. A method of inhibiting rust comprising applying to a substrate calcium 3-pentafluoroethyl-6-hydroxybenzoate.

4. A method of inhibiting rust comprising applying to a substrate triethanol amine salt of p-tertiarynonafluorobutylbenzenesulfonate.

5. A method of inhibiting rust comprising applying to a substrate sodium p-trifluoromethylbenzenesulfonyl aminoacetate.

6. A method of inhibiting rust comprising applying to a substrate p-pentafluoroethylphenyl thioacetate.

7. The method of claim 1, wherien the compound is potassium m-trifluoromethylbenzotriazole salt.

8. The method of claim 1, wherein the compound is m-trifluoromethyl benzotriazole.

9. A method of inhibiting rust comprising applying to a substrate dicyclohexylamine p-trifluoromethylphenylsutfonate salt.

10. A method of inhibiting rust comprising applying to a substrate potassium m-tertiarynonafluorobutyl saccharine salt.

11. A method of inhibiting rust comprising applying to a substrate sodium p-trifluoromethylbenzoate.

* * * * *

UNITED STATES PATENT AND TRADEMARK OFFICE

CERTIFICATE OF CORRECTION

PATENT NO. : 5,573,708
DATED : November 12, 1996
INVENTOR(S) : Shigeru OTOMO

It is certified that error appears in the above-indentified patent and that said Letters Patent is hereby corrected as shown below:

Claim 1, column 6, line 10, "-S-C(SH)-N'" should read -- -S-C(SH)-N- --.

Claim 9, column 6, lines 30-31, "p-trifluoromethylphenylsutfonate" should read -- p-trifluoromethylphenylsulfonate --.

Signed and Sealed this

Seventh Day of January, 1997

*Attest:*

BRUCE LEHMAN

*Attesting Officer*

*Commissioner of Patents and Trademarks*